US009073017B2

(12) United States Patent
Trottier et al.

(10) Patent No.: US 9,073,017 B2
(45) Date of Patent: Jul. 7, 2015

(54) REHYDRATION CAPSULE AND METHOD OF USING THE SAME

(75) Inventors: Keith D. Trottier, Moorpark, CA (US); Christopher A. Meissner, Camarillo, CA (US)

(73) Assignee: Meissner Filtration Products, Inc., Camarillo, CA (US)

( * ) Notice: Subject to any disclaimer, the term of this patent is extended or adjusted under 35 U.S.C. 154(b) by 232 days.

(21) Appl. No.: 13/336,489

(22) Filed: Dec. 23, 2011

(65) Prior Publication Data

US 2012/0314530 A1 Dec. 13, 2012

Related U.S. Application Data

(60) Provisional application No. 61/495,280, filed on Jun. 9, 2011.

(51) Int. Cl.

| | |
|---|---|
| ***B01F 15/00*** | (2006.01) |
| ***B01F 5/06*** | (2006.01) |
| ***B01F 5/02*** | (2006.01) |
| ***B01F 1/00*** | (2006.01) |
| ***B01F 5/00*** | (2006.01) |

(52) U.S. Cl.

CPC ..... *B01F 5/0206* (2013.01); *B01F 1/0033* (2013.01); *B01F 5/0057* (2013.01)

(58) Field of Classification Search

CPC ..... B01F 5/0206; B01F 1/0033; B01F 5/0057

USPC ..... 366/167.1, 177.1, 179.1, 174.1, 175.2, 366/336, 340, 172.2, 173.1, 173.2

See application file for complete search history.

(56) References Cited

U.S. PATENT DOCUMENTS

| | | | | |
|---|---|---|---|---|
| 1,693,829 | A | 12/1928 | Sweeney | |
| 2,820,701 | A | 1/1958 | Leslie | |
| 3,343,918 | A | 9/1967 | Moulder | |
| 4,197,942 | A * | 4/1980 | Gacki et al. | 366/167.1 |
| 4,715,393 | A * | 12/1987 | Newton | 366/167.1 |
| 5,093,084 | A * | 3/1992 | Boden et al. | 366/175.2 |
| 5,680,959 | A * | 10/1997 | Ettore et al. | 222/1 |
| 6,305,845 | B1 * | 10/2001 | Navin | 383/67 |
| 7,829,039 | B2 * | 11/2010 | Schubert et al. | 366/167.1 |
| 2002/0196702 | A1 * | 12/2002 | Shechter | 366/167.1 |
| 2003/0094418 | A1 | 5/2003 | Barlow | |
| 2005/0150823 | A1 | 7/2005 | Eserkaln et al. | |
| 2006/0204405 | A1 | 9/2006 | Tryggvason et al. | |
| 2009/0010098 | A1 * | 1/2009 | Schall et al. | 366/167.1 |

FOREIGN PATENT DOCUMENTS

DE 33 26 459 A1 1/1985

OTHER PUBLICATIONS

Invitation to Pay Additional Fees and Communication Related to the Results of the Partial International Search dated Apr. 13, 2012, for International Application No. PCT/US2012/021109, Filed Jan. 12, 2012; 9 Pages.

* cited by examiner

*Primary Examiner* — Tony G Soohoo
*Assistant Examiner* — Anshu Bhatia
(74) *Attorney, Agent, or Firm* — Christie, Parker & Hale, LLP

(57) ABSTRACT

A rehydration capsule, and a method of rehydrating media within such capsule, the capsule including a capsule body having an inlet and an outlet, a member proximate the inlet having at least an opening therethrough, a filter proximate the outlet, and a hollow flow tube corresponding to each of said at least one opening mounted to the member and having an inlet at one end aligned with the at least one opening and having at least one opening through its body.

27 Claims, 9 Drawing Sheets

REHYDRATION CAPSULE AND METHOD OF USING THE SAME

CROSS-REFERENCE TO RELATED APPLICATION

This application is based upon and claims priority on U.S. Provisional Application No. 61/495,280, filed on Jun. 9, 2011, the contents of which are fully incorporated herein by reference.

BACKGROUND OF THE INVENTION

The present invention is directed to a rehydration capsule or a system for hydrating media, such as cell culture media which is typically used to grow cells such as mammalian cells and bacteria, as for example, the GIPCO® AGT media, using a capsule filled with such media and circulating water in the capsule until the media is dissolved. Typically, such media are rehydrated by using mechanical mixers. Such mixers, however, require significant operator skill in ensuring that the media is properly introduced to the mixer in the correct amount and, more importantly, without contamination. Conventional mixers are typically constructed of stainless steel and must be thoroughly cleaned after each use. This cleaning process is time consuming and difficult. The cleaning method and procedure must also be carefully validated to be consistent and sufficiently clean. This validation step is challenging and difficult. To overcome the problems related to cleaning, single use mixers are now widely available. Single use mixers are designed so that all wetted components are used only once and are discarded after each use and typically consist of an appropriately sized multi-layer plastic chamber with integrated agitator which is often magnetically coupled so that the plastic chamber is completely closed and isolated from the drive system. However, such mixers are expensive. Thus, it is desirable to have a system that can contain the proper amount of media to be hydrated and which can be easily installed by an operator without concern for contamination or errors. The meaning of "hydrated media" as used herein means that the media is completely dissolved in the hydrating liquid, whereby the media is no longer a solid.

SUMMARY OF THE INVENTION

In an exemplary embodiment, a rehydration capsule is provided. The exemplary rehydration capsule includes a capsule body having an inlet and an outlet, a member proximate the inlet having at least an opening therethrough, a filter proximate the outlet, and a hollow flow tube corresponding to each of the at least one opening mounted to the member, and having an inlet at one end aligned with the at least one opening, and having at least one opening through its body. In another exemplary embodiment, the hollow flow tube has a closed end opposite the flow tube inlet, and a fluid flowing through the capsule body inlet will flow though said at least one hollow tube inlet and will exit through the hollow tube at least one opening formed through the hollow tube body. In another exemplary embodiment, the includes a single hollow tube having a plurality of openings proximate the member. In yet another exemplary embodiment, each of the plurality of openings is a slit formed through the body of the single hollow tube and all of the plurality of openings are arranged at a same height level. In a further exemplary embodiment another plurality of openings are formed through the single hollow tube wall above the plurality of openings. In yet a further exemplary embodiment, the plurality of openings is greater in number than the another plurality of openings.

In a further exemplary embodiment, the capsule includes three hollow flow tubes, where each hollow flow tube has an inlet at one end and a closed opposite end and an opening through its body. The member also has three openings and each flow tube inlet is aligned with one of the openings of the member, such that a flow through the capsule body inlet will flow through each of the flow tube inlets and exit through the flow tube openings. In yet another exemplary embodiment, the capsule body has at least a portion that is cylindrical, and each of the flow tubes is arranged around a central longitudinal axis of the body cylindrical portion. With this exemplary embodiment, the openings of two of the flow tubes are aligned to provide a flow generally perpendicular to a radius extending from the central longitudinal axis and a third of the flow tubes is aligned to provide a flow towards the central longitudinal axis. In yet another exemplary embodiment, each flow tube includes at least two openings through its body, one axially aligned over the other. In another exemplary embodiment, each of the openings through each flow tube body is an elongated slot. In yet another exemplary embodiment, the capsule body includes a body portion and an inlet port. The inlet of the capsule body is formed on the inlet port. The inlet port is coupled to the capsule body portion. In a further exemplary embodiment, the outlet of the capsule body is formed on an outlet port. The outlet port is coupled to the capsule body portion. In yet a further exemplary embodiment, the capsule body includes a body portion and an outlet port. The outlet of the capsule body is formed on the outlet port. The outlet port is coupled to the capsule body portion. In one exemplary embodiment, the outlet port is threaded to the capsule body portion. In another exemplary embodiment, at least one of the flow tubes is formed from a flexible material, and the opening formed through the at least one of the flow tubes body is a slit. In yet another exemplary embodiment, the member includes a nipple for the at least one of the flow tubes and the at least one of the flow tubes is fitted over a corresponding nipple, and the at least one opening on the member is formed through the nipple. In a further exemplary embodiment, the at least one of the flow tubes has a closed end closed with a plug. In yet a further exemplary embodiment, the inlet is formed on an inlet port and the outlet is formed on an outlet port and the inlet and outlet ports are connected to a body portion of the body. In one exemplary embodiment, at least one of the inlet and outlet ports is thermally welded to the body portion. In another exemplary embodiment, at least one of the inlet and outlet ports is threaded to the body portion. In yet another exemplary embodiment, at least one of the inlet and outlet ports includes a trough for receiving the body portion. In a further exemplary embodiment, at least one of the member and the filter is directly connected to the inlet port or the outlet port. In yet a further exemplary embodiment, the capsule is mounted on a frame having at least a plunger for exerting a force against at least one of the inlet and outlet ports of the capsule.

In another exemplary embodiment, a method of rehydrating media within an elongated capsule is provided. The method includes providing a tangential flow of hydrating liquid within the capsule so as to provide a swirling motion about a central longitudinal axis of the capsule. In a further exemplary embodiment, a longitudinal flow is provided at two different height levels within the capsule. In yet a further exemplary embodiment, the method includes providing a radial flow of hydrating liquid in the capsule. In any of the aforementioned exemplary embodiments, the hydrating liquid is water.

In yet another exemplary embodiment, a method of rehydrating media within an elongated capsule is provided. The method includes providing a flow of hydrating liquid within the capsule to create a mixture of media and liquid so as to hydrate the media and passing the mixture through a filter allowing the hydrated media to pass without allowing the media that has not been hydrated to pass. In a further exemplary embodiment, the flow is provided transversely to a longitudinal axis of said elongate capsule.

DETAILED DESCRIPTION

Figure 1:
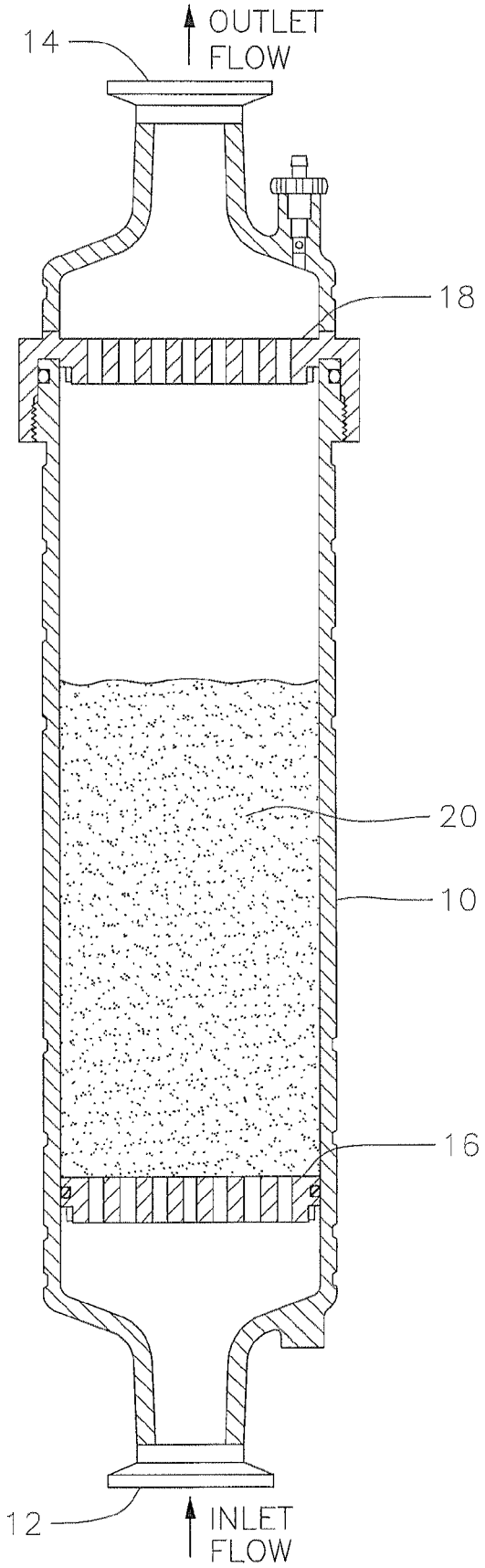
FIG. 1 is a cross-sectional view of an exemplary embodiment rehydration capsule.

A first embodiment rehydration capsule 10 includes an inlet 12 and outlet 14 as well as a movable disk 16 proximate the inlet which is perforated to allow for penetration by water but not by the media. The capsule also includes a perforated fixed outlet disc 18 fixed proximate the outlet. As water enters the inlet, the force of the water pushes the movable disk up until the disk impinges against the culture media 20. The water also penetrates the perforations of the inlet disk, causing the culture media to swell. In other prior art embodiments, the movable disk, is actually fixed, and thus not moveable, so as to provide a spacing at an upper end of the capsule between the media and the outlet filter disk. Applicant, however, has discovered that with this capsule, the media turns gelatinous at times and causes a significant decrease in the flow rate through the outlet and often completely blocks flow through the perforated outlet disk.

Figure 2:
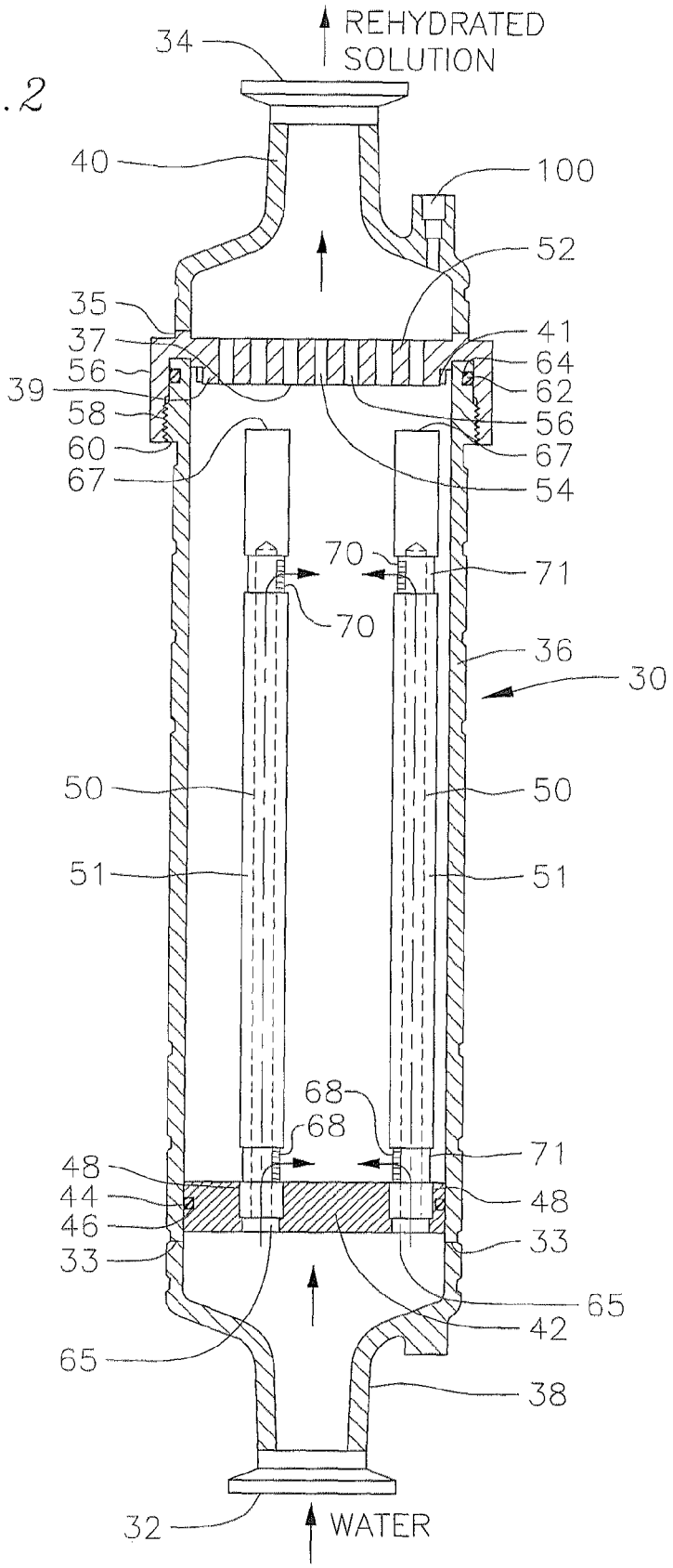
FIG. 2 is a cross-sectional view of an exemplary embodiment rehydration capsule of the present invention.
Figure 3:
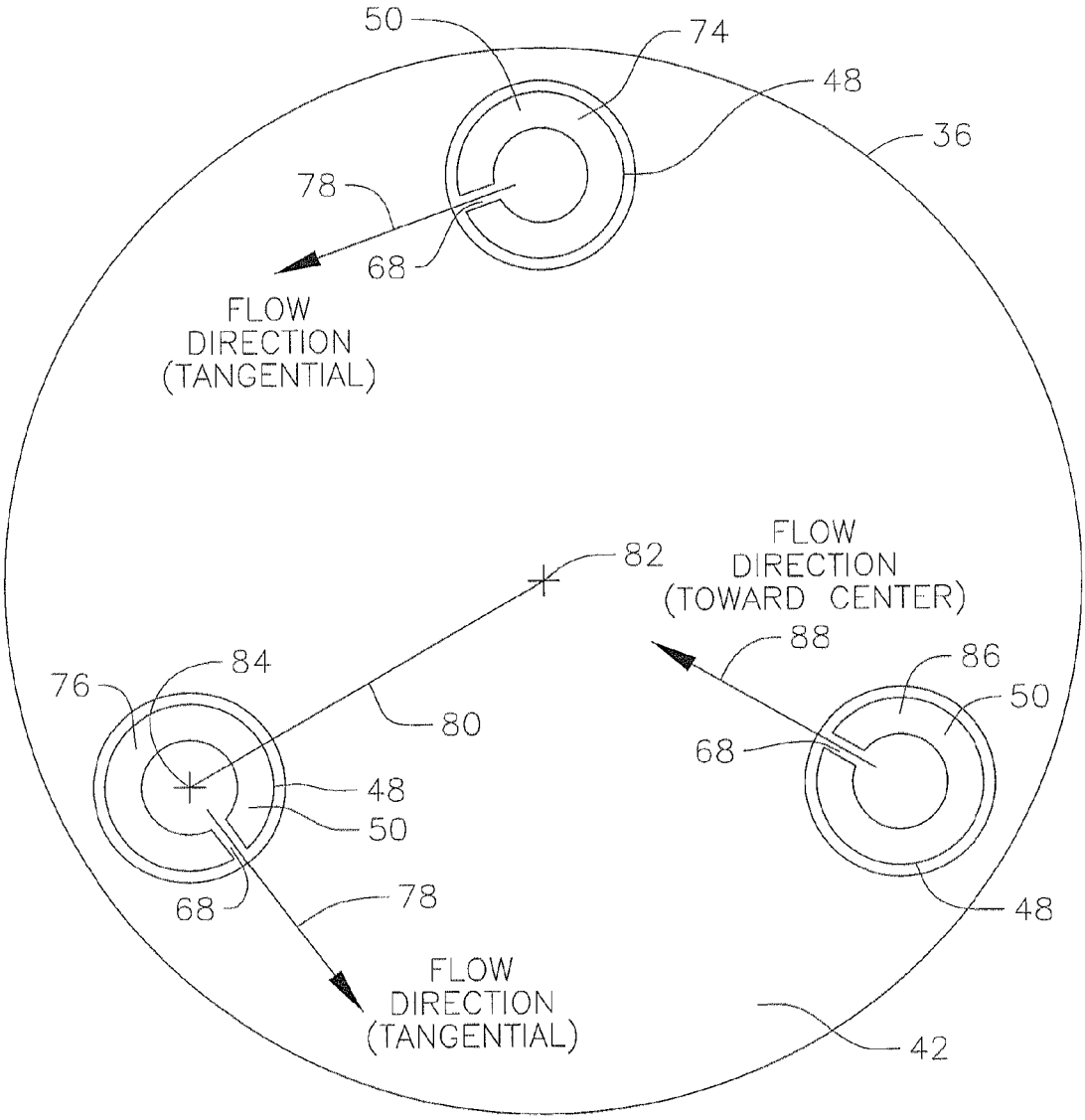
FIG. 3 is top cut-away view of an exemplary embodiment rehydration capsule of the present invention.

In an improved exemplary embodiment, a capsule 30 has a body and is provided having an inlet 32 for receiving water or other liquid and an outlet 34, as for example shown in FIG. 2. In the exemplary embodiment, the capsule includes a body portion 36, which in an exemplary embodiment is cylindrical. An inlet port 38 defining the inlet 32 is threaded or otherwise attached to an inlet end of the body portion. In the exemplary embodiment shown in FIG. 2, the inlet port is thermally welded to the body portion along seam 33. An outlet port 40 defining the outlet 34 is threaded or otherwise attached to the opposite end of the body portion. In an exemplary embodiment, a disk 42 (referred to herein as the "inlet disk") is fixed proximate the inlet end of the capsule body portion. The inlet disk may be interference fitted into the capsule body portion. A seal 44, as for example an O-ring seal may be fitted between the outer perimeter of the inlet disk and the capsule body portion. In an exemplary embodiment, as shown in FIG. 2, the O-ring seal may be fitted in a peripheral groove 46 formed on the peripheral outer surface of the inlet disk. In another exemplary embodiment, the seal may be fitted in a groove formed on the inner surface of the body portion. The inlet disk, in an exemplary embodiment, includes a plurality openings 48 to accommodate plurality of flow tubes 50. In the exemplary embodiment shown in FIG. 3, three openings 48 are provided, each for accommodating a flow tube. While this exemplary embodiment is being described with using three flow tubes, in other exemplary embodiments, more then three flow tubes may be utilized, or less than three flow tubes may be utilized, as for example shown in FIG. 6. At the outlet end of the capsule body portion, an outlet port 40 is threaded or otherwise coupled to the capsule body portion. In the exemplary embodiment shown in FIG. 2, the outlet port is thermally welded along a seam 35 to a disk 52 (referred to herein as the "outlet disk"). In the shown exemplary embodiment, the outlet disk 52 is perforated (i.e., has perforations 54 through its thickness) and is covered with a separate filtering medium 37. The filtering medium has pores which prevent the "dry" media, prior to rehydration from escaping there through while having sufficient size to allow for completely dissolved media as well as a liquid to penetrate the same such that it can exit through the perforations 54 and through the outlet. AGT media, typically reduces to about 5 microns or less in size when properly hydrated. In an exemplary embodiment, the outlet disk forms a projection 39 and the filtering media 37 is wrapped over the perforations 54 and around a periphery 41 of the projection. In an exemplary embodiment, the filtering media is thermally welded to the projection, as for example to the periphery 41 of the projection. In an exemplary embodiment the filtering media is made of melt blown polypropylene fibers of approximately 20 to 30 microns. In another exemplary embodiment, only the filtering media is provided and attached to the body portion or the outlet port in lieu of the outlet disk in combination with the filtering media. In yet another exemplary embodiment, an outlet disk may be provided having pores small enough so as to no warrant use of a filtering media 37.

In an exemplary embodiment, the outlet disk includes a peripheral lip 56 that attaches to the outer surface of the body portion. In the exemplary embodiment shown in FIG. 2, the peripheral lip has threads 58 formed on its inner surface which thread onto threads 60 formed on the outer surface of the body portion. A seal 62, as for example an O-ring seal may be fitted between the inner surface of the peripheral lip and the outer surface of the outer surface of the capsule body portion. In an exemplary embodiment, as shown in FIG. 2, the O-ring seal 62 may be fitted in a peripheral groove 64 formed on the outer surface of the capsule body portion. In another exemplary embodiment, the seal may be fitted in a groove formed on the inner surface of the peripheral lip. In another exemplary embodiment, the outlet disk 52 may be their rally welded to the body portion after filling the capsule with media thereby eliminating the need for a seal. The outlet port in the exemplary embodiment is attached to the outlet disk by thermally welding along seam 35. In another exemplary embodiment, the outlet port may be integrally formed with the outlet disk.

In an exemplary embodiment, the inlet port, body portion, outlet port, inlet and outlet disks and the flow tubes may be made from polypropylene.

In an exemplary embodiment, each flow tube 50 includes a hollow body 51 defining a hollow flow chamber 53 (best seen in FIG. 2), an inlet 65 opposite a closed end 67 and two outlet slots 68, 70 along the flow tube body. Each slot is spaced apart from the other slot within each flow tube. In each flow tube, the first outlet slot 68 is positioned proximate the flow tube inlet 65, or the inlet disk 42, and the second outlet slot 70 is positioned at a location which would be above the level of the media to be rehydrated when the media is inserted in the capsule body and preferably proximate the outlet port. Typically, the media, prior to rehydration, occupies about 60% or less of the capsule body length as measure from the surface of the inlet disk facing the outlet disk. The inlet end of each flow tube is fitted within an inlet disk opening 48. When the inlet tube is fitted within its corresponding opening, water entering the inlet of the capsule will enter through the flow tube inlet 65 inlet and exit through the two slots 68, 70 of the tube. In an exemplary embodiment, the first slot 68 is linearly aligned with the second slot 70 in each flow tube. In an exemplary embodiment utilizing three flow tubes, the flow tubes are arranged such that the slots of two of the flow tubes 74 and 76 are positioned to direct the water flow through the flow tubes in a direction 78 generally tangentially to the capsule body portion. In other words, the flow is directed in a direction generally perpendicular to a radius 80 from a central axis 82 of the capsule body portion to a central axis 84 of the flow tube, as for example shown in FIG. 3. One of the tubes 86, however, is arranged such that the flow 88 from its outlet slots 68, 70 is toward the central axis 82 of the capsule and along a radius.

Applicants have discovered that this orientation of the outlet slots of the three flow tubes provides for proper hydration of the media and prevents the media from turning gelatinous. This orientation of the outlet slots creates a swirling flow through the capsule to sufficiently mix the media and hydrate the same with water. As the media expands, it is subjected to the flow from the upper slots 70 of the flow tubes further aiding in the mixing and dissolving of the media. By controlling the pressure of the inlet flow, the swirling motion may be controlled such that it can create a vortex or it may be decreased to prevent a vortex from generating. The radial flow through the third tube further aids in the mixing of the water with the media for better hydrating the same. Applicants have discovered by positioning the first slots proximate the inlet port and the other slots at the top (and proximate the outlet port when each tube only has two slots), the time needed for proper mixing and hydrating of the media is reduced. In such an exemplary embodiment, Applicants have discovered that they can get proper mixing and rehydration of the media such that it can easily flow through the perforated outlet disk.

In an exemplary embodiment, the thickness of the flow tube is reduced in the area 71 surrounding the slot. The reduced thickness area allow the use of a clip to other member to hold a flexible material having a slit or a filter material over the slot. The flexible material serves as a one-way valve expanding and its slit forming an opening when the flow from the flow tube exits the slot so as to allow the flow to penetrate said flexible material. The slit closes when flow from the flow tube stops and thus, prevents back flow of the media into the flow tube. In other exemplary embodiments, the flexible material or filter may be otherwise connected to the reduced thickness area of the flow tube.

Figure 4A:
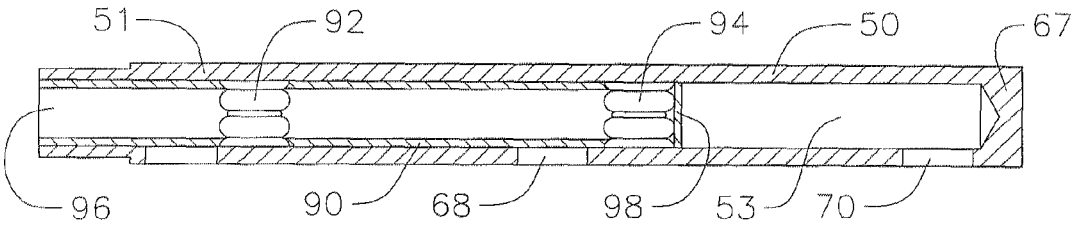
FIGS. 4A and 4B are cross-sectional view of exemplary embodiment flow tubes including sleeves for incorporation in an exemplary embodiment rehydration capsule of the present invention.
Figure 4B:
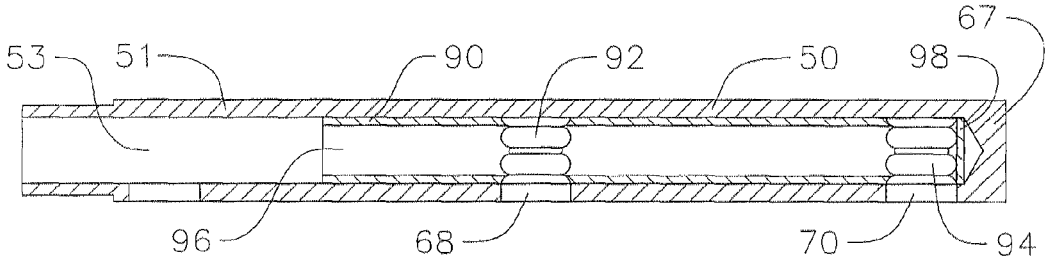

In another exemplary embodiment, a sleeve 90 is provided within each flow tube 50 having slots 92 which correspond in spacing to the slots 68 and 70 on such flow tube (FIGS. 4A and 4B). Each sleeve has an open end 96 and a closed end 98. The sleeve is such that when flow enters the open end of the flow tube and thus the open end of the sleeve, it forces the sleeve to travel upwards within the flow chamber 53 of the flow tube until the closed end 98 of the sleeve is prevented from further upward travel by the closed end 67 of the flow tube. When at that location, the sleeve slots 92 and 94 are aligned with the flow tube slots 68 and 70, respectively, as for example shown in FIG. 4B. When water stops flowing to the sleeve, or when the water pressure is sufficiently reduced, the sleeves slide back downward such that the slots 92, 94 of the sleeve are no longer aligned with the slots 68, 70 of the flow tube, as for example shown in FIG. 4A, thereby preventing the backward flow of water and/or media from the capsule into the flow tube. In an exemplary embodiment, the sleeve has slots formed around its entire circumference such that even if the sleeve were to rotate, an opening can be aligned with the correct corresponding slot on the flow tube.

Figure 5:
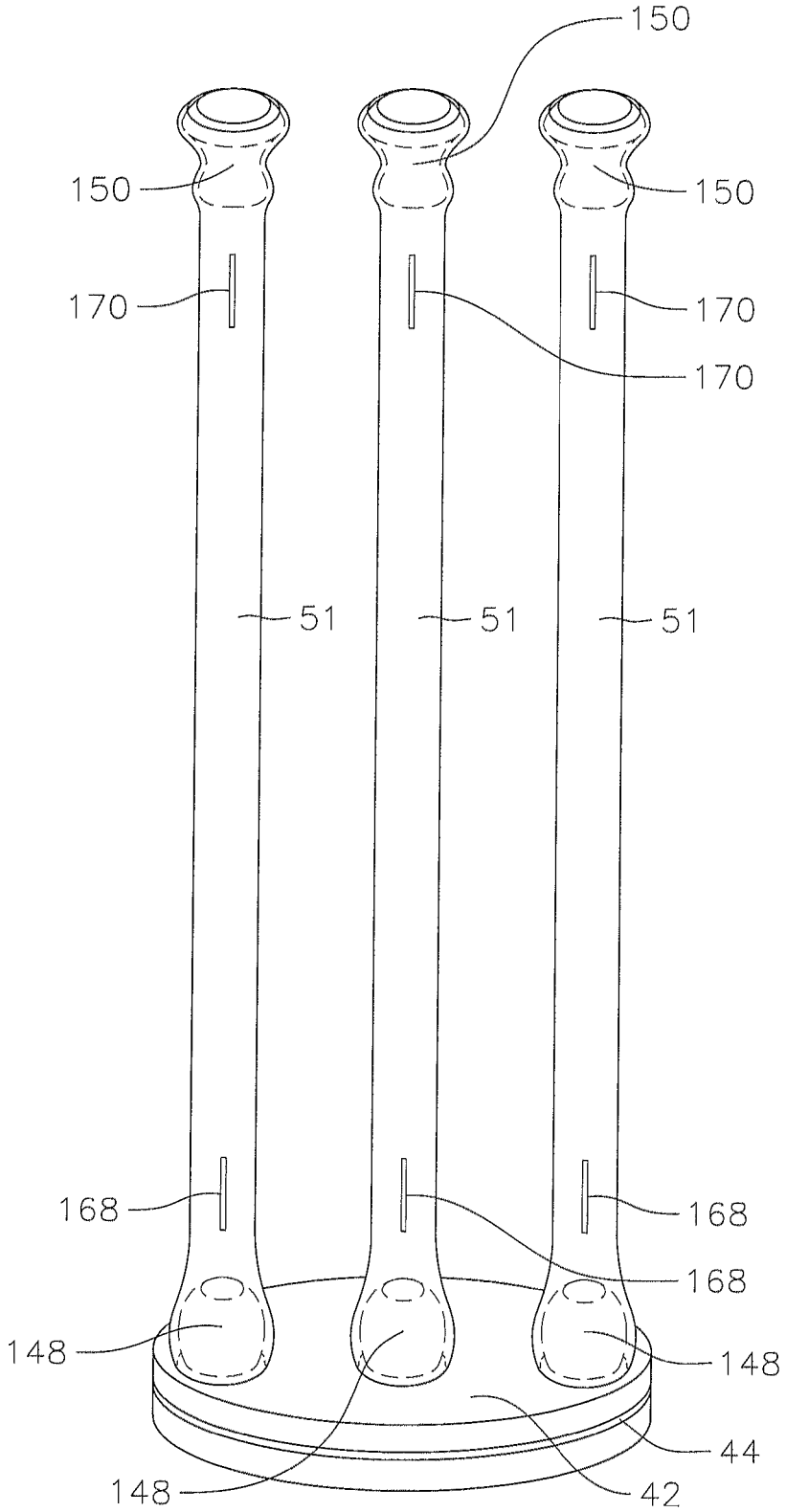
FIG. 5 is a perspective view of another exemplary embodiment inlet disk with flexible flow tubes for incorporation in an exemplary embodiment rehydration capsule of the present invention.

In another exemplary embodiment as shown in FIG. 5, instead of openings 48, the inlet disk is provided with nipples 148 with an opening formed through each nipple to allow for flow from the inlet 32 into the flow tubes 51. Each flow tube is fitted over each nipple as for example shown in FIG. 5. In another exemplary embodiment, as for example shown in FIG. 5, each flow tube is made from a flexible material such as silicone and is slid over a corresponding nipple on the inlet disk. In the exemplary embodiment shown in FIG. 5, each flow tube is a pliable hose. A plug 150 is placed at opposite end of such hose to close such end. Slits, as for example, 168 and 170 are formed on each tube in lieu of the slots. When water flows through each flexible flow tube it causes the flow tube to expand and the slits to open so that the water may flow through them. When the water flow stops, the flow tubes contract and the slits close so as to prevent the back flow of the media into the flow tubes.

In yet a further exemplary embodiment, in order to prevent the flow of liquid and of the media backwards through the slot, each flow tube may provided with an internal flexible sleeve such as a rubber or silicone sleeve having slits that are aligned with the slots on the tube such that when water enters the open end of the tube, it enters the sleeve causing it to expand and for the slits in the sleeve to expand so as to allow flow to exit through the slits in the sleeve and through the slots of the flow tube. When water stops flowing through the sleeve, the slits in the sleeves close preventing flow of water and/or media back through the slot of each flow tube and through each corresponding slit in the sleeve.

In addition, Applicants discovered with the exemplary embodiment capsule, a shorter capsule may be used than compared to the capsules which do not incorporate the flow tubes.

In an exemplary embodiment, to place the media into the capsule, the outlet of the capsule, as well as the outlet disk 52 are separated from the capsule body portion 36, as for example they may be unthreaded from the capsule body portion. In other exemplary embodiment, the outlet 40 and the outlet disk may be integrally formed. In another exemplary embodiment, as for example shown in FIG. 6, the outlet disk 52 may be mated to the outlet port 40, and the outlet port 40 is mated to the capsule body portion 36. Similarly the inlet disk 42 is mated to the inlet port and the inlet port is mated to the capsule body portion. The inlet and outlet disks may be press fitted into their corresponding inlet or outlet ports and may include seals between their outer surface and the inner surface of the ports. As can be seen in the exemplary embodiment shown in FIG. 6 the inlet and outlet each form an annular trough 172 for receiving a corresponding end of the capsule body portion 36. Seals 174 may be between the inner and outer surfaces of the capsule body portion and the surfaces of the troughs to seal and frictionally hold the inlet port 38 and outlet port 40 in place. Such seals may be placed in grooves formed on either the troughs or the capsule body portion.

A vent 100 may be provided to allow for purging of any air that may have entered the capsule when the media is placed into the capsule, as for example shown in FIG. 2.

Figure 6:
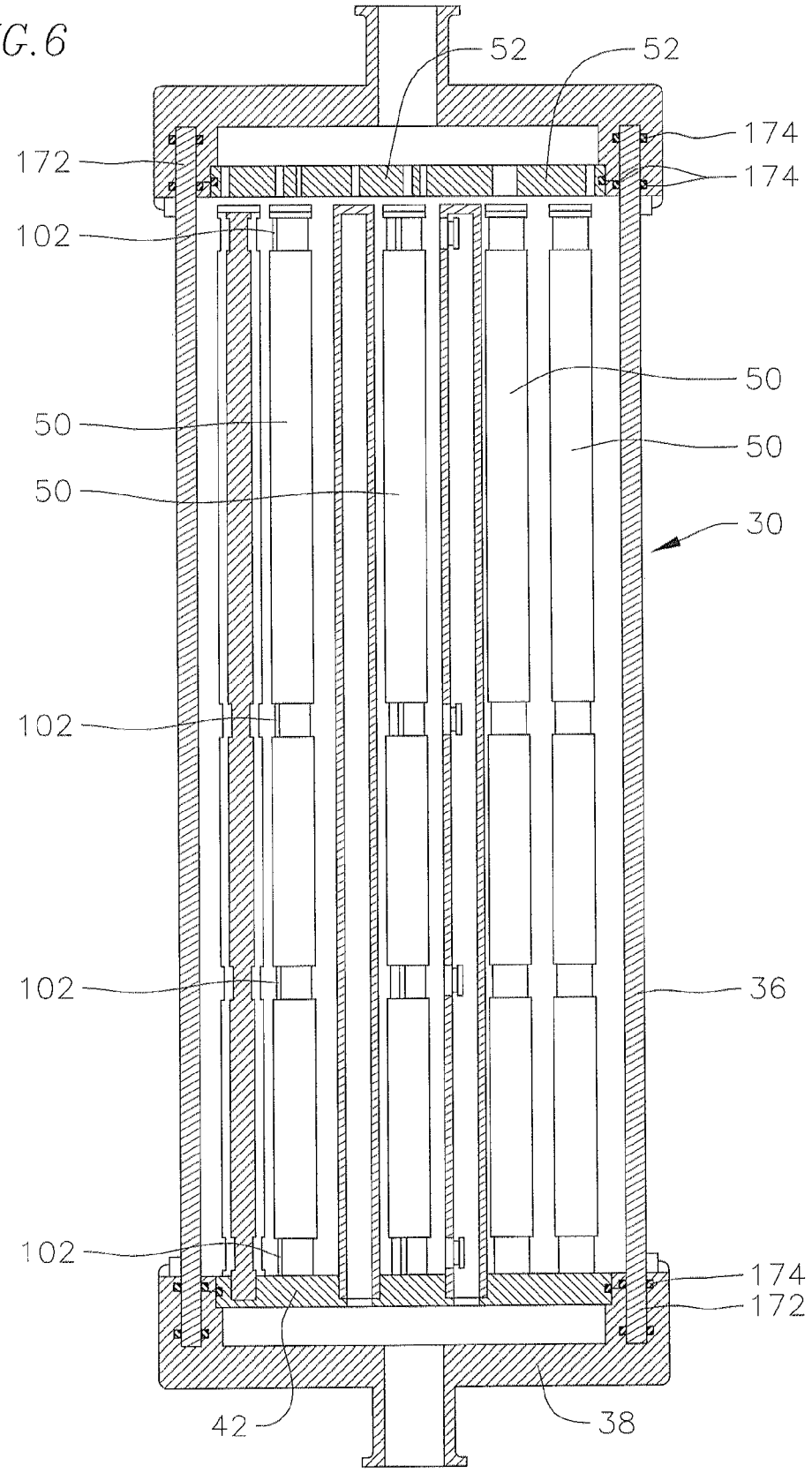
FIG. 6 is a cross-sectional view of another exemplary embodiment rehydration capsule of the present invention.

In yet another exemplary embodiment, each flow tube may have more than one slot. In addition, the size of the slots may be altered for controlling the mixing and the hydration of the media with the water. For example, as shown in FIG. 6 for larger capsules each flow tube may have four outlet slots 102. In addition, in other exemplary embodiments, the orientation of the slots within each flow tube may not be linearly aligned.

Figure 7:
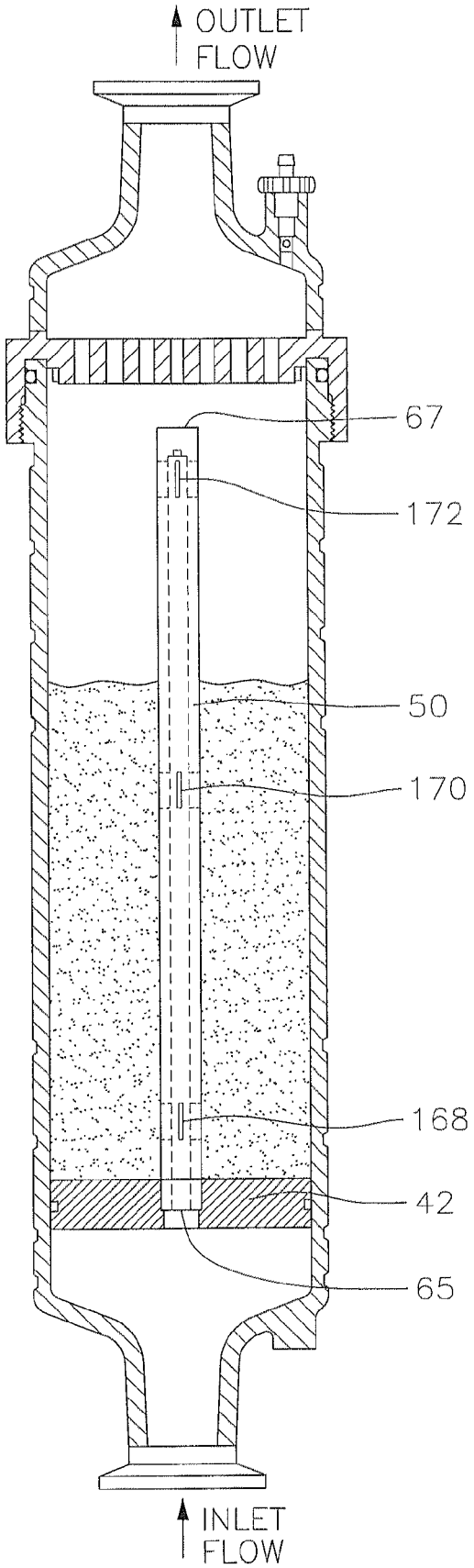
FIG. 7 is a cross-sectional view of another exemplary embodiment rehydration capsule of the present invention.
Figure 8A:
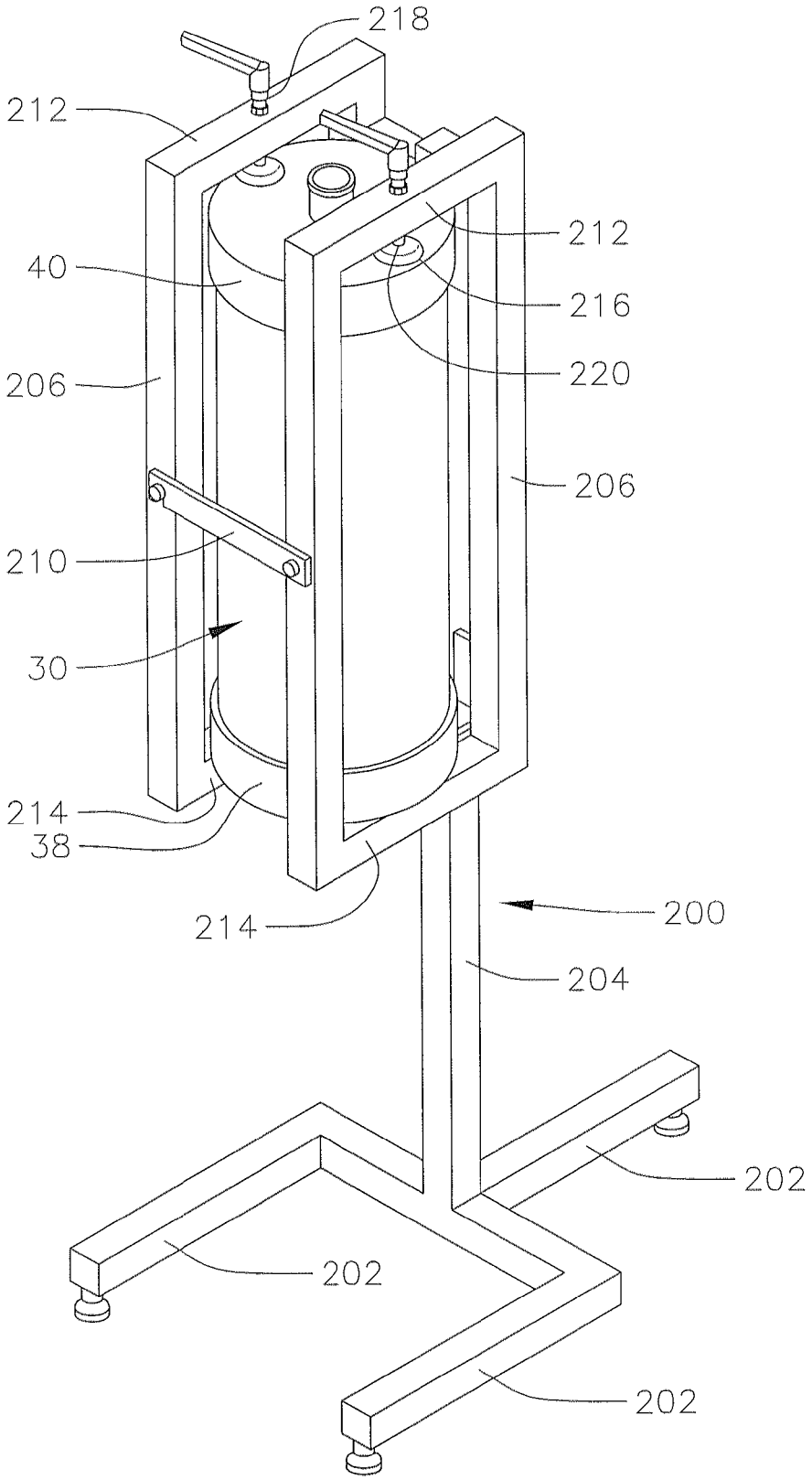
FIGS. 8A, 8B, 8C and 8D are perspective, front, side and top views of the exemplary embodiment rehydration capsule shown in FIG. 6 mounted in an exemplary embodiment stand of the present invention.
Figure 8D:
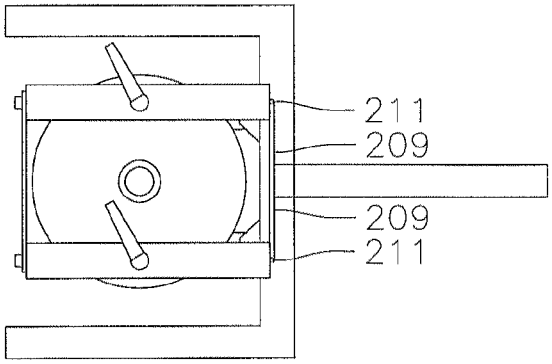
Figure 8B:
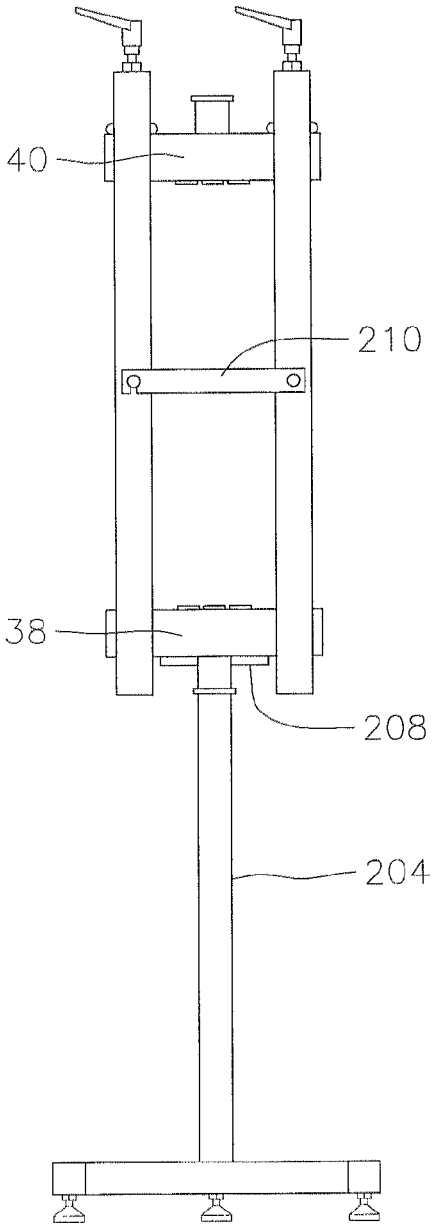
Figure 8C:
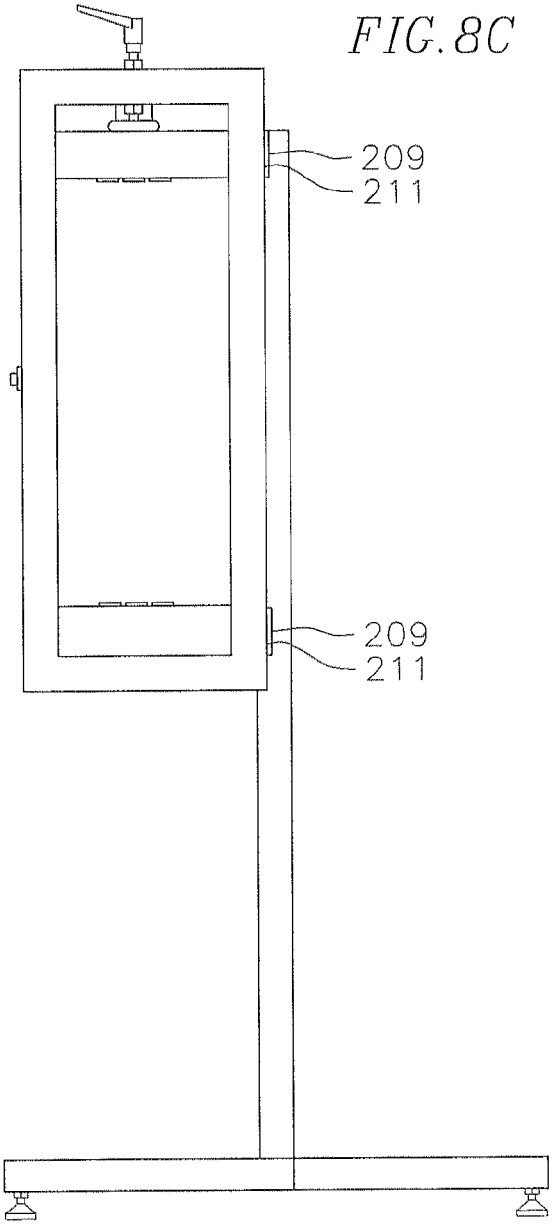

In another exemplary embodiment, the capsule includes only a single flow tube 50, as for example shown in FIG. 7. The single flow tube may be of any flow tube described in relation to any of the exemplary embodiments herein. The flow tube is hollow having an inlet 65 opposite in closed end 67. The single flow tube in another exemplary embodiment has an opening 168 proximate the inlet disk 42. In a further exemplary embodiment, the single flow tube has a plurality of openings 168 around the flow tube at, or proximate, the same level, proximate the inlet disk to allow for radial flow of the water into the media. For example, the flow tube may include twelve openings 168, each opening spaced apart by 30° from an adjacent opening. In another exemplary embodiment, the single flow tube may include one or more openings 170 at a level above the opening(s) 168 and may also include a further set of openings 172 at yet another level. In the exemplary embodiment, shown in FIG. 7, the openings are slits formed through the flow tube wall. In a further exemplary embodiment, the flow tube is formed from a flexible material. In one exemplary embodiment, the number of openings at a level proximate the inlet disk are greater than the total number of openings above such level. Applicant has discovered that using more openings at proximate the inlet disk, i.e., at the bottom of the capsule, improves mixing when the capsule is oriented vertically and gravity keeps the media to be hydrated at the bottom, adjacent to the inlet disk. In another embodiment, the openings area and/or the number of openings is greater at a lower level than at an upper level. For example, in the embodiment where the openings are formed by longitudinally oriented slits, the slits at level proximate the inlet disk are longer than the slits at higher levels.

In an exemplary embodiment as shown in FIGS. 8A, 8B, 8C and 8D a stand 200 may be provided for holding the capsule 30. The stand includes at least a foot 202. A leg 204 is connected to the foot. Two quadrilateral frames, which in the exemplary embodiment shown in FIGS. 8A, 8B, 8C and 8D are rectangular frames 206, are coupled to the leg 204 as for example via a coupling members 209 in FIG. 8B and hinges 211 which allow the frames to pivot for installation and removal of the capsule. The capsule may be supported by an optionally support plate 208 coupled to the leg 204 until the rectangular frames 206 can be closed to encompass the capsule. In an exemplary embodiment, the support plate is stationary relative to the leg or one of the frames. The two frames, in an exemplary embodiment, are also coupled to each other via a linking element 210.

To use the stand, the frames are swung open about their corresponding hinges 211, the capsule is placed between the frames (and if a support plate is used, the capsule is placed on the support plate) and the frames are pivoted back such that an upper cross member 212 of each frame extends over the outlet port 40 and a lower cross member 214 of each frame extends below the inlet port 38. The two frames are then linked together with a linking element 210, i.e., the linking element is fastened to the frames. Plungers 216 are coupled to the upper cross members. In the shown exemplary embodiment, each plunger includes a threaded post 218 threaded through its corresponding cross member and a head 220. As each post is threaded through its cross member it causes its corresponding head to apply a force against the outlet port pressing the capsule against the lowest cross member or the support plate 208, if closed. This force not only retains the capsule in position it also helps keep the inlet and outlet ports connected to the body portion in cases where pressure builds up in the capsule body. In other exemplary embodiments, the plungers may be threaded to the lower cross members in addition or in lieu of being threaded to the upper cross members of the frames.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A rehydration capsule comprising:

a capsule body having an inlet and an outlet longitudinally opposite the inlet, wherein the outlet is downstream from the inlet;

a member within the capsule body between said inlet and outlet, said member being downstream from said inlet and proximate the inlet and having at least one opening there through for receiving a fluid flow through the inlet;

a filter upstream of the outlet and proximate the outlet; and a hollow flow tube corresponding to each of said at least one opening mounted to the member and having an inlet at one end aligned with the at least one opening of the member for receiving said fluid flow through said at least one opening and having at least one opening through its body, wherein the filter is downstream from said at least one opening formed through the hollow flow tube body, and wherein said hollow tube extends in an axial direction from said member toward said filter, and wherein an annular space is formed between the hollow tube and the capsule body, said annular space extending radially from the hollow tube toward said capsule body for receiving said fluid.

2. The capsule as recited in claim 1, wherein said at least one hollow flow tube has a closed end opposite the flow tube inlet, wherein a fluid flowing through said capsule body inlet will flow though said at least one hollow tube inlet and will exit through said hollow tube at least one opening formed through the body of the at least one hollow tube.

3. The capsule as recited in claim 2, wherein said capsule comprises a single hollow tube comprising a plurality of openings proximate the member.

4. The capsule as recited in claim 3, wherein each of the plurality of openings of said single hollow tube is a slit formed through the body of said single hollow tube and wherein all of said plurality of openings are arranged at a same height level.

5. The capsule as recited in claim 4, further comprising another plurality of openings formed through the single hollow tube wall above said plurality of openings.

6. The capsule as recited in claim 5, wherein said plurality of openings formed through said single hollow tube is greater in number than said another plurality of openings formed through said single hollow tube.

7. The capsule as recited in claim 2, wherein said capsule comprises three hollow flow tubes, each hollow flow tube having an inlet at one end and closed opposite end and an opening through its body, wherein the member comprises three openings and wherein each flow tube inlet is aligned with one of said openings is said member, wherein a flow through said capsule body inlet will flow through each of said flow tube inlets and exit through said flow tube openings.

8. The capsule as recited in claim 7, wherein said capsule body has at least a portion that is cylindrical, wherein each of the flow tubes is arranged around a central longitudinal axis of said at least a portion that is cylindrical, wherein the openings of two said flow tubes are aligned to provide a flow generally perpendicular to a radius extending from said central longitudinal axis and wherein a third of said flow tubes is aligned to provide a flow towards said central longitudinal axis.

9. The capsule as recited in claim 8, wherein each flow tube comprises at least two openings through its body one axially aligned over the other.

10. The capsule as recited in claim 9, wherein each of said openings through each flow tube body is an elongated slot.

11. The capsule as recited in claim 8, wherein the capsule body comprises a body portion and an inlet, wherein the inlet of said capsule body is formed on an inlet port, and wherein the inlet port is coupled to the capsule body portion.

12. The capsule as recited in claim 11, wherein the capsule body comprises an outlet port, wherein the outlet of said capsule body is formed on the outlet port, and wherein the outlet port is coupled to the capsule body portion.

13. The capsule as recited in claim 8, wherein the capsule body comprises a body portion and an outlet port, wherein the outlet of said capsule body is formed on the outlet port, and wherein the outlet port is coupled to the capsule body portion.

14. The capsule as recited in claim 13, wherein the outlet port is threaded to a portion of the capsule body.

15. The capsule as recited in claim 1, wherein at least one of said flow tubes is formed from a flexible material, and wherein said opening formed through said at least one of said flow tubes' body is a slit.

16. The capsule as recited in claim 15, wherein the member comprises a nipple for said at least one of said flow tubes and wherein said at least one of said flow tubes is fitted over a corresponding nipple, wherein said at least one opening on said member is formed through the nipple.

17. The capsule as recited in claim 1, wherein said at least one of said flow tubes has a closed end closed with a plug.

18. The capsule as recited in claim 1, wherein the inlet is formed on an inlet port and the outlet is formed on an outlet port and wherein the inlet and outlet ports are each connected to a portion of the capsule body.

19. The capsule as recited in claim 18, wherein at least one of the inlet and outlet ports is thermally welded to the portion of the capsule body.

20. The capsule as recited in claim 18, wherein at least one of the inlet and outlet ports is threaded to the portion of the capsule body.

21. The capsule as recited in claim 18, wherein at least one of the inlet and outlet ports includes a trough for receiving the portion of the capsule body.

22. The capsule as recited in claim 18, wherein at least one of the member and the filter is directly connected to the inlet port or the outlet port.

23. The capsule as recited in claim 1, mounted on a frame having at least a plunger for exerting a force against at least one of the inlet and outlet ports of the capsule.

24. The capsule of claim 1, comprising a plurality of openings formed through the member and a plurality of hollow flow tubes.

25. The capsule of claim 24, wherein the member is axially spaced apart from said inlet and from said outlet.

26. The capsule of claim 1, wherein the member is axially spaced apart from said inlet and from said outlet.

27. The capsule of claim 1, wherein the hollow tube is mounted on said member.

* * * * *